US008899443B2

(12) United States Patent
Soibel et al.

(10) Patent No.: US 8,899,443 B2
(45) Date of Patent: Dec. 2, 2014

(54) CONTAINER ASSEMBLY WITH FLEXIBLE SEAL

(75) Inventors: Randy Soibel, Chicago, IL (US); Tyson Manullang, Chicago, IL (US); Kieron Tse, Chicago, IL (US)

(73) Assignee: WKI Holding Company, Inc., Rosemont, IL (US)

( * ) Notice: Subject to any disclaimer, the term of this patent is extended or adjusted under 35 U.S.C. 154(b) by 92 days.

(21) Appl. No.: 12/638,636

(22) Filed: Dec. 15, 2009

(65) Prior Publication Data

US 2010/0147846 A1 Jun. 17, 2010

Related U.S. Application Data

(60) Provisional application No. 61/122,590, filed on Dec. 15, 2008.

(51) Int. Cl.
*B65D 41/16* (2006.01)
*B65D 43/02* (2006.01)

(52) U.S. Cl.
CPC ..... *B65D 43/0212* (2013.01); *B65D 2205/00* (2013.01); *B65D 2543/00194* (2013.01); *B65D 2543/00296* (2013.01); *B65D 2543/0049* (2013.01); *B65D 2543/00537* (2013.01); *B65D 2543/00555* (2013.01); *B65D 2543/00564* (2013.01); *B65D 2543/00611* (2013.01); *B65D 2543/00685* (2013.01); *B65D 2543/00731* (2013.01); *B65D 2543/00796* (2013.01); *B65D 2543/00824* (2013.01); *B65D 2543/00972* (2013.01)
USPC ..... 220/795; 220/378

(58) Field of Classification Search
CPC ..... B65D 51/1611; B65D 2543/00296; B65D 53/02; B65D 25/54; B65D 43/00; B65D 2543/00092; B65D 2543/00537; B65D 2543/00685; B65D 43/162; A47J 36/027; F16J 15/48; F16J 13/08; B60K 15/0406; B60K 15/0409; F01P 11/0238; B65F 1/1615
USPC ..... 215/301, 345, 795, 315, 377, 378, 346, 215/317, 341, 220, 221; 220/806, 803–804, 220/796, 715, 304; 292/327
See application file for complete search history.

(56) References Cited

U.S. PATENT DOCUMENTS 1,369,969 A 1/1921 Fairbanks et al.
2,047,720 A 7/1936 Wilhelm
(Continued)

FOREIGN PATENT DOCUMENTS

EP 0112295 A2 12/1983

*Primary Examiner* — Fenn Mathew
*Assistant Examiner* — Kevin Castillo
(74) *Attorney, Agent, or Firm* — McDermott Will & Emery LLP

(57) ABSTRACT

A storage container assembly comprises, a storage receptacle, a removable lid, and a seal. The storage receptacle has a base and a continuous sidewall connected to the base. The sidewall has an interior surface and an exterior surface. The lid has a main body that covers at least a portion of the storage receptacle. The lid has a first and a second receiving channel. The seal has a securing member and a blade portion. The securing member goes into the first receiving channel of the lid to connect the seal to the lid. The blade portion of the seal contacts the interior surface of the sidewall. The exterior surface of the sidewall contacts the second receiving channel. The sidewall of the storage receptacle is within the second receiving channel. The blade portion forms a generally fluid tight seal with the sidewall while the sidewall contacts the second receiving channel.

11 Claims, 4 Drawing Sheets

(56) References Cited

U.S. PATENT DOCUMENTS

| | | | | | |
|---|---|---|---|---|---|
| 2,234,485 | A | | 3/1941 | Connor | |
| 3,273,743 | A | | 9/1966 | McColl | |
| 3,688,942 | A | | 9/1972 | Mitchell et al. | |
| 4,078,696 | A | | 3/1978 | Crisci | |
| 4,308,965 | A | * | 1/1982 | Dutt | 215/345 |
| 4,402,641 | A | * | 9/1983 | Arff | 411/510 |
| 4,466,552 | A | | 8/1984 | Butterworth et al. | |
| 5,065,885 | A | | 11/1991 | Scaroni | |
| 5,337,913 | A | | 8/1994 | Fukuda | |
| 5,405,038 | A | | 4/1995 | Chuang | |
| 5,427,266 | A | | 6/1995 | Yun | |
| 5,641,065 | A | | 6/1997 | Owens et al. | |
| 5,743,420 | A | * | 4/1998 | Loffler et al. | 215/270 |
| 5,785,201 | A | | 7/1998 | Bordner et al. | |
| 5,921,432 | A | | 7/1999 | Van Berne et al. | |
| 5,944,211 | A | | 8/1999 | Woodnorth et al. | |
| 5,974,686 | A | | 11/1999 | Nomura et al. | |
| 5,988,423 | A | * | 11/1999 | Auzureau | 220/233 |
| 6,035,769 | A | | 3/2000 | Nomura et al. | |
| 6,116,151 | A | | 9/2000 | Fickert et al. | |
| D431,419 | S | | 10/2000 | Greene | |
| D440,470 | S | | 4/2001 | Tucker et al. | |
| D443,184 | S | | 6/2001 | Maxwell et al. | |
| D443,798 | S | | 6/2001 | Tucker et al. | |
| D445,649 | S | | 7/2001 | Maxwell et al. | |
| 6,364,152 | B1 | * | 4/2002 | Poslinski et al. | 220/788 |
| 6,415,945 | B1 | | 7/2002 | Zank et al. | |
| 6,415,947 | B1 | | 7/2002 | Kim | |
| 6,494,338 | B1 | | 12/2002 | Schultz | |
| 6,557,720 | B2 | | 5/2003 | Tosdale et al. | |
| 6,568,534 | B2 | | 5/2003 | Zank | |
| 6,581,939 | B1 | | 6/2003 | Theros et al. | |
| 6,685,046 | B2 | | 2/2004 | Ogino | |
| 6,698,336 | B1 | | 3/2004 | Siegel et al. | |
| D493,073 | S | | 7/2004 | Kim | |
| D496,560 | S | | 9/2004 | Lerner | |
| 6,793,096 | B1 | | 9/2004 | Seok | |
| D501,764 | S | | 2/2005 | Lerner | |
| 6,877,633 | B2 | | 4/2005 | Niese | |
| D505,840 | S | | 6/2005 | Schultz et al. | |
| D512,278 | S | | 12/2005 | Schultz et al. | |
| 7,077,282 | B2 | | 7/2006 | Tondar et al. | |
| 7,086,326 | B2 | | 8/2006 | Yokoyama | |
| 7,114,617 | B2 | | 10/2006 | Yewdall et al. | |
| D553,444 | S | | 10/2007 | de Groote et al. | |
| 7,413,099 | B2 | | 8/2008 | Takahashi et al. | |
| 7,648,041 | B2 | * | 1/2010 | Ueda et al. | 220/378 |
| 2002/0195455 | A1 | * | 12/2002 | Takahashi et al. | 220/806 |
| 2003/0116572 | A1 | | 6/2003 | Klock et al. | |
| 2003/0178428 | A1 | | 9/2003 | Chang | |
| 2005/0006390 | A1 | | 1/2005 | Wang | |
| 2005/0205577 | A1 | | 9/2005 | Park | |
| 2007/0095849 | A1 | * | 5/2007 | Kim | 220/803 |
| 2007/0170190 | A1 | | 7/2007 | Milesi et al. | |
| 2008/0041852 | A1 | | 2/2008 | Cai | |
| 2008/0083752 | A1 | | 4/2008 | Mantyla et al. | |

* cited by examiner

CONTAINER ASSEMBLY WITH FLEXIBLE SEAL

RELATED APPLICATIONS

The present application claims priority to U.S. Provisional Application No. 61/122,590 filed on Dec. 15, 2008, which is hereby incorporated by reference herein in its entirety.

TECHNICAL FIELD

The present invention relates to a container assembly, and more particularly, to a container assembly with a flexible seal.

BACKGROUND OF THE INVENTION

When storing leftover food, or food that is to be prepared at a later time, it is common to utilize a container assembly that comprises a storage vessel and a lid that is removably securable to the storage vessel. These types of container assemblies have existed for a long period of time, however, often times a generally fluid tight seal is not properly formed between the storage vessel and the lid of the container assembly. A proper generally fluid tight seal may not be formed for a variety of reasons, ranging from slight manufacturing defects, such as slight surface defects, to the limitations in manufacturing products to exact specifications. Additionally prior seals may be difficult to install within the lid, or may not form a proper seal if a portion of the storage vessel that the seal contacts has any food material present.

Thus, it would be useful to provide a container assembly having a removable lid with an improved generally fluid tight seal. Therefore, a need exists for a storage assembly with an improved generally fluid tight seal.

The present invention is provided to solve the problems discussed above and other problems, and to provide advantages and aspects not previously provided. A full discussion of the features and advantages of the present invention is deferred to the following detailed description, which proceeds with reference to the accompanying drawings.

SUMMARY OF THE INVENTION

According to one embodiment, a storage container assembly has a generally fluid tight seal and comprises, a storage receptacle, a removable lid, and a seal. The storage receptacle has a base and a continuous sidewall connected to the base. The sidewall has an interior surface and an exterior surface. The removable lid has a main body that covers a peripheral edge of the sidewall of the storage receptacle. The lid has a first receiving channel, and a second receiving channel. The seal has a securing member and a blade portion. The securing member is at least partially disposed in the first receiving channel of the lid to connect the seal to the lid. The blade portion of the seal contacts the interior surface of the sidewall. The exterior surface of the sidewall of the storage receptacle contacts the second receiving channel of the lid. The sidewall of the storage receptacle is located within the second receiving channel. The blade portion of the seal forms a generally fluid tight seal with the sidewall while the sidewall contacts the second receiving channel.

According to one process, a method of forming a container assembly having a generally fluid tight seal is provided. The method provides a storage receptacle that has a base and a continuous sidewall. A removable lid that has a flexible seal is also provided. The removable lid has a first receiving channel and a second receiving channel. The flexible seal has a securing member and a blade portion. The securing member of the flexible seal is at least partially disposed in the first receiving channel of the lid. The removable lid aligns with the storage receptacle, such that the second receiving channel is proximate to the sidewall of the storage receptacle. The lid is secured to the storage receptacle. The sidewall of the storage receptacle displaces an exterior wall of the second channel and displaces the blade portion of the seal and secures the lid to the storage receptacle and further causes the sidewall of the storage receptacle contacts both the blade portion of the seal and the exterior wall of the second channel to affix the lid to the storage receptacle.

According to another embodiment, a removable lid with a generally fluid tight seal for use with a storage receptacle comprises a main body, and a seal. The removable lid has a main body configured to cover an at least a portion of a base of a storage receptacle, a receiving channel, and a protruding member. The seal has a securing member and a blade portion. The securing member is configured to engage with the protruding member to connect the seal to the lid. The blade portion of the seal is configured to contact an interior surface of a sidewall of a storage receptacle. When the exterior surface of the sidewall of the storage receptacle contacts the receiving channel of the lid, the sidewall is located within the receiving channel. The blade portion of the seal forms a generally fluid tight seal with the sidewall and the sidewall contacts the receiving channel.

According to a further embodiment, a lid assembly for a storage container comprises a lid portion and a seal. The lid portion has a main body a receiving channel, and a seal receiving portion. The seal has a securing member and a blade portion. The securing member interacts with the seal receiving portion of the lid to removable secure the seal to the lid. The blade portion of the seal is flexible to be movable from a first generally horizontal orientation to a second generally vertical orientation to form a sealing surface.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

Figure 1:
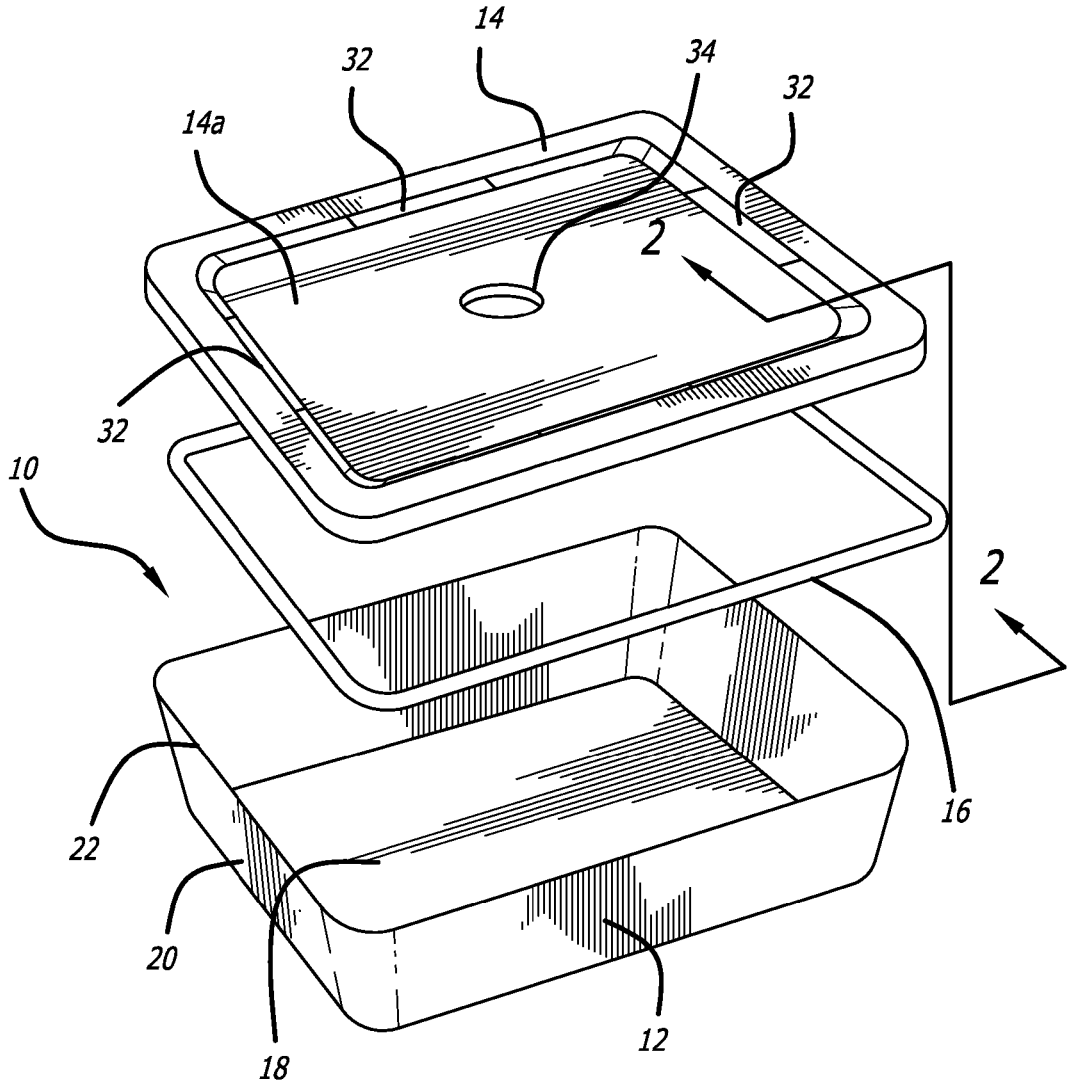
FIG. 1 is an exploded pictorial view of a container assembly according to one embodiment.

The components in the drawings are not necessarily to scale, emphasis instead being placed upon clearly illustrating the principles of the present invention.

DETAILED DESCRIPTION

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2A:
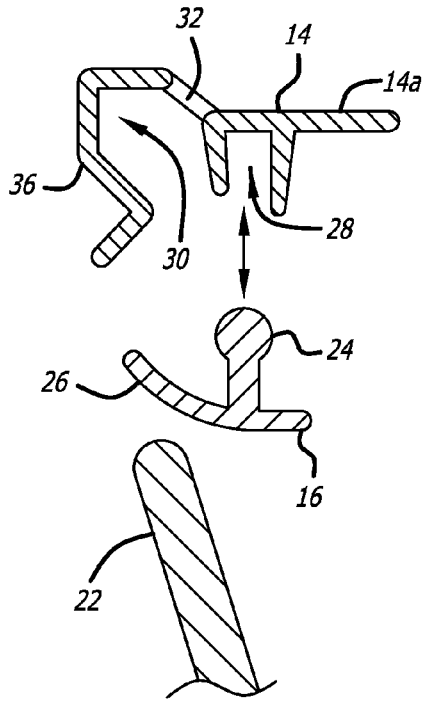
FIGS. 2*a*-2*c* depict a partial cross sectional view taken along line 2-2 of FIG. 1 showing an area near a periphery of the container assembly.
Figure 2B:
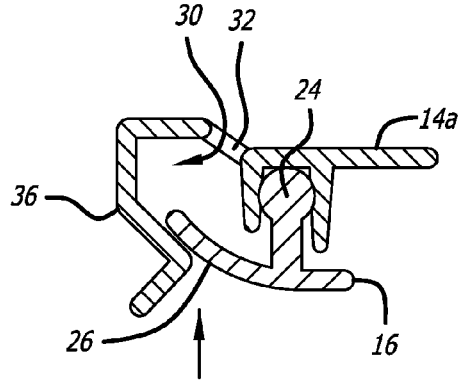
Figure 2C:
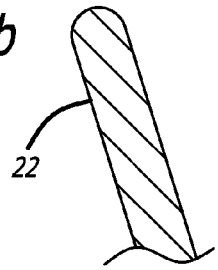
Figure 2C:
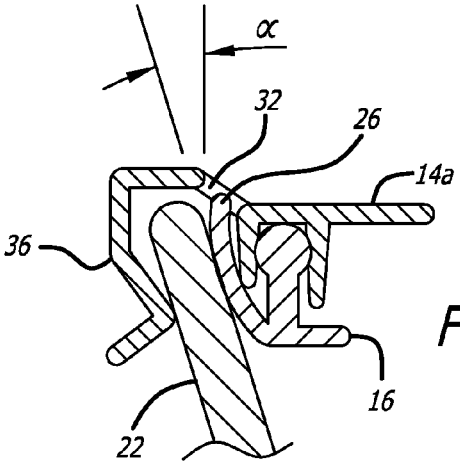

According to one embodiment of the present invention, as shown in FIGS. 1-2*c*, a container assembly 10 is provided. As will be discussed below, according to one aspect of the invention, the container assembly 10 comprises a storage vessel 12, a lid portion 14, and a flexible seal 16. The storage vessel 12 comprises a base portion 18 and a continuous sidewall 20 projecting upward from the base portion 18. The sidewall 20 begins at the base portion 18 and terminates at an upper peripheral edge 22. It is contemplated that the base portion 18 of the storage vessel 12 may be provided in a variety of shapes, such as a rectangle, as shown in FIG. 1, a square, a triangle, an oval, a circular shape, or any other shape into which a container may be configured. It is further contemplated that the edge 22 of the sidewall 20 will generally be rounded. Providing a rounded edge 22 reduces the wear on the seal 16 and also decreases the likelihood of a user being cut by the storage vessel 12. A rounded edge 22 may also increase the strength of the edge 22 by providing a greater amount of material in that location, thus reducing the likelihood of breaking the storage vessel 12.

As shown in FIGS. 2*a*-2*c*, the lid portion 14 has a first channel 28 and a second channel 30. The first channel 28 is adapted to receive a securing member 24 of the seal 16. As shown in FIGS. 2*a*-2*c*, the first channel 28 is generally perpendicular to a main surface 14*a* of the lid 14. The main surface 14*a* may have a vent 34 to release pressure within the container assembly 10 to ease the removal of the lid 14. It is contemplated that the vent 34 may be a manual vent, that requires a user to open and close the vent or an automatic vent, that does not require a user to open and close the vent. The securing member 24 is adapted to be inserted into the first channel 28 of the lid 14 and a press fit, friction fit, or interference fit, secures the seal 16 to the lid 14. It is also contemplated that other fastening techniques may be used to attach a seal to a lid, such as an adhesive, a mechanical fastener such as a screw, a pin, a clip, or other fastener technologies. When the seal 16 is secured to the lid 14, without the lid interacting with the storage vessel 12, a blade portion 26 of the seal is positioned within the second channel 30. As shown in FIG. 2*b*, the blade portion 26 of the seal is biased to be positioned near an exterior wall 36 of the second channel 30 of the lid 14. The exterior wall 36 of the second channel 30 of the lid 14 is adapted to be displaced outwardly in order to receive the rounded edge 22 of the sidewall 20. The second channel 30 additional may optionally have a viewing window 32. The viewing window 32 is adapted to provide a visual indication of whether the lid 14 is secured to the storage vessel 12 while the seal 16 engages the sidewall 22. It is contemplated that the seal 16 may be injection molded silicone, a thermoplastic vulcanizate (TPV), a thermoplastic rubber (TPR), or a thermoplastic elastomer (TPE).

As shown in FIG. 2*c*, the exterior wall 36 of the second channel 30 forms a press fit against an outer surface of the sidewall 22 of the storage vessel 12. The blade portion 26 of the seal 16 presses against an opposite side of the sidewall 22 as the exterior wall 36 of the second channel 30. The blade portion 26 is displaced upwardly, such that the blade portion 26 is generally vertical when the lid 14 is properly connected to the sidewall 22 of the storage receptacle 20. Thus, in one preferred embodiment, the blade portion 26 forms an angle $\alpha$ less than forty-five degrees (45°), and generally about thirty degrees (30°). It is contemplated that the blade portion 26 may be generally vertical, e.g., within twenty degrees (20°) of being vertical.

Additionally, a distal end of the blade portion 26 of the seal 16 is positioned such that the viewing window 32 provides a visual indication if the lid 14 is sealed to the storage vessel 12.

To form a container assembly, the securing member 24 of seal 16 is pressed into the first channel 28 of the lid 14. The securing member 24 forms a friction, or press, fit between the seal 16 and the lid 14. Next the lid 14 and seal 16 assembly is positioned near the rounded edge 22 the sidewall 20 of the storage vessel 12. The sidewall 20 deflects the exterior wall 36 of the second channel 30 outward, such that the second channel 30 receives the distal end of the sidewall 20, and an exterior side of the sidewall 20 contacts the exterior wall 36 of the second channel 30. This contact assists in forming a friction fit between the lid 14 and the storage vessel 12. While the exterior side of the sidewall 20 contacts the second channel 30, an interior side of the sidewall 20 contacts the blade portion 26 of the seal 16. The contact between the seal 26 and the storage vessel sidewall 22 deflects the blade portion 26 vertically into the second channel 30. As shown in FIG. 2*c*, it is contemplated that the blade portion 26 contacts, or is in close proximity to, a wall of the second channel 30 that is generally opposite the exterior wall 36. Thus, the sidewall 22 is secured between the exterior wall 36 of the second channel 30 and the blade portion 26 of the seal 22, resulting in a very secure lid 14 on the container assembly 10.

Figure 3:
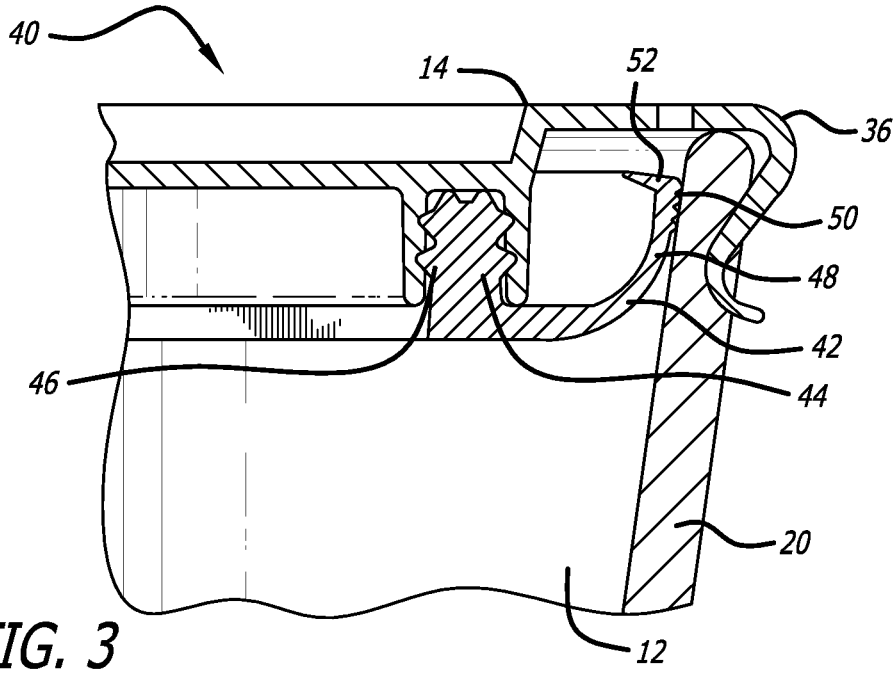
FIG. 3 is a partial cross sectional view of a similar area near a periphery of a container assembly according to another embodiment.

Turning now to FIG. 3, a container assembly 40 is shown according to another embodiment. The container assembly 40 comprises the storage vessel 12, the lid portion 14, and a seal 42. The seal 42 has a securing member 46 and a blade portion 48. The securing member 46 as a plurality of ribs 46. The ribs 46 extend from a periphery of the securing member 46 to secure the seal 42 to the first channel 28 of the lid 14 via a press fit, a friction fit, or an interference fit.

The blade portion 48 additionally has a plurality of ribs 50 adapted to contact the sidewall 20 of the storage receptacle 12. Each of the ribs 50 contacts the sidewall 20 form a separate seal with the sidewall 20. Thus, if a defect exists in the sidewall 20 of the storage receptacle 12, the ribs 50 increase the likelihood of obtaining at least one fluid proof seal where one of the ribs 50 contacts the sidewall 20, even if defects may be present where another rib 50 contacts the sidewall. As shown in FIG. 3. a distal region 52 of the blade portion 42 is generally vertical, i.e., less than twenty degrees (20°) from being vertical.

The lid 14 with the seal 42 is secured to the storage receptacle 12 in a generally identical manner as described in connection with FIGS. 1-2*c*. The only substantial difference is the plurality of ribs 50 of the seal 42 contact the sidewall 20 of the storage receptacle, increasing the likelihood that a proper generally fluid tight seal is formed on the container assembly 40 when the lid 14 is in place. It is contemplated that a viewing window, similar to the viewing window 32 described above, may optionally be provided on container assembly 40.

Figure 4:
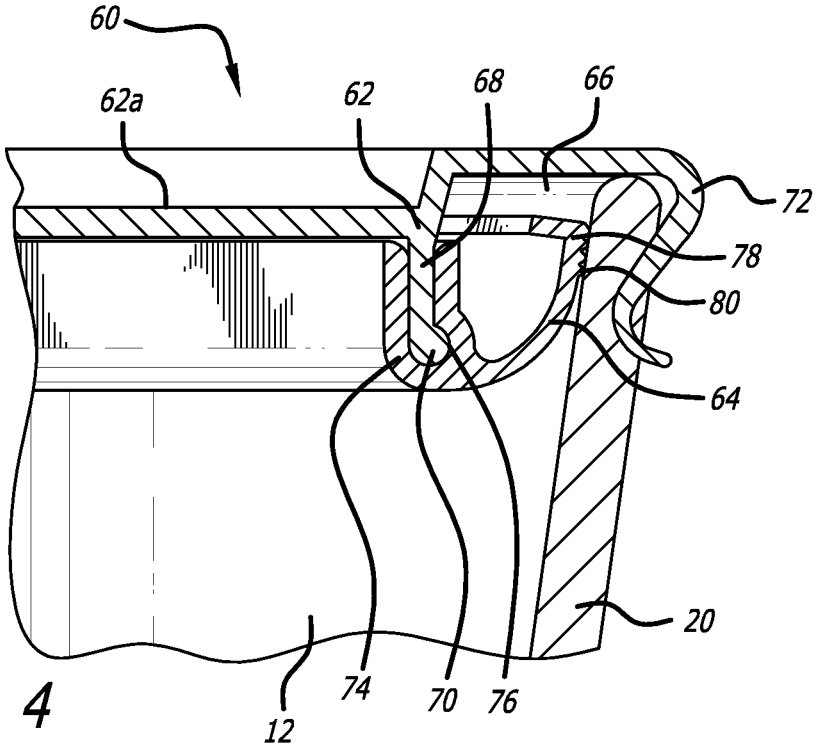
FIG. 4 is a partial cross sectional view of a similar area near a periphery of a container assembly according to a further embodiment.

A further embodiment of a container assembly 60 is depicted in FIG. 4. The container assembly 60 comprises the storage vessel 12, a lid 62 and a seal 64. The lid 62 has a channel 66 and a protruding member 68. The protruding member extends outwardly from a bottom surface of a main body portion 62*a* of the lid 62. The lid 64 has a barb 70 located at a distal end of the protruding member 68. The channel 66 of the lid 62 forms between an exterior wall 72 and the protruding member 68. As with previous embodiments, the exterior wall 72 is adapted to displace outwardly to receive the sidewall 20 of the storage vessel 12. It is contemplated that a viewing window, similar to the viewing window 32 described above, may optionally be provided on the lid 62.

The seal 64 comprises a securing member 74 having a barb receiving portion 76 and a blade portion 78. The blade portion 78 may have a plurality of sealing ribs 80 adapted to form a fluid proof seal when the ribs 80 contact the sidewall 20 of the storage receptacle. The barb receiving portion 76 fits at least partially around the barb 70 of the lid 62 to secure the seal 64 to the lid 62. The lid 62 and the seal 64 may then be applied to the storage receptacle 12 to form the container assembly 60.

To secure the lid 62 to the storage receptacle 12 to form the container assembly 60, the lid 62 is positioned such that the channel 66 is located above the sidewall 20. As the lid 62 is lowered an exterior surface of the sidewall 20 displaces the exterior wall 72 of the lid 62 outward. An interior surface of the sidewall 20 additionally contacts the seal 64, displacing the blade portion 78 of the seal 64 in an upward direction such that at least one of the plurality of ribs 80 contact the interior surface of the sidewall 20 of the container 12 to form a generally fluid tight seal. It is contemplated that a distal end of the blade portion 78 may contact the lid 62 near the protruding member 68 to enhance the generally fluid tight seal, i.e., make the seal less likely to allow fluid flow.

Figure 5:
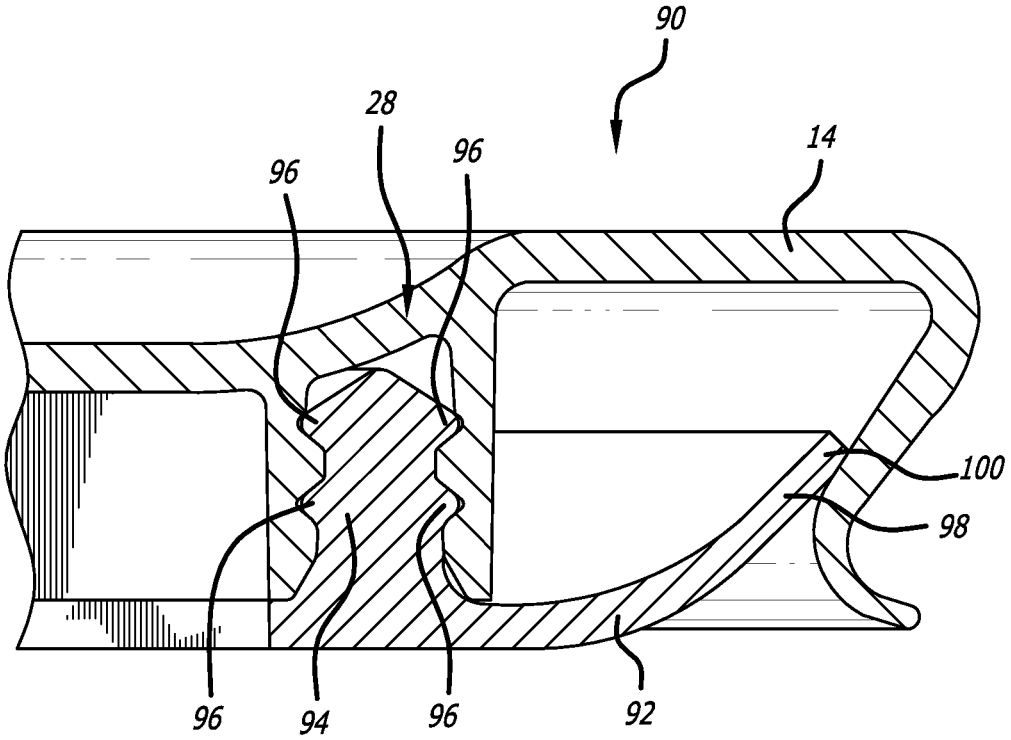
FIG. 5 is a partial cross sectional view of a similar area near a periphery of a lid assembly for a container assembly according to a further embodiment.

Turning now to FIG. 5, a container lid assembly 90 is shown according to another embodiment. The container lid assembly 90 comprises the lid portion 14 and a seal 92. The seal 92 has a securing member 94 and a blade portion 98. The securing member 94 has a plurality of ribs 96. The ribs 96 extend from a periphery of the securing member 94 to secure the seal 92 to the first channel 28 of the lid portion 14 via a press fit, a friction fit, or an interference fit.

The blade portion 98 is adapted to contact a sidewall of a storage receptacle to form a generally fluid tight seal, similar to that shown in FIGS. 2*a*-2*c*.

It is additionally contemplated that the seals 16, 42, 64, 92 may be replaced if through use they fail to continue to provide a generally fluid tight seal.

The seals 16, 42, 64, 92 may additionally be removed from a lids 14, 62 in order to better clean the seals 16, 42, 64, 92, or the lids 14, 62.

It is contemplated that a variety of materials may be utilized to form components of the container assemblies 10, 40, 60 disclosed herein. For example, it is contemplated that the storage receptacle 12 may be manufactured from at least one of the following materials: glass, acrylic, polystyrene, polyethylene, or other known polymeric materials. The lids 14, 62 may be manufactured from a TPE or other known polymeric materials. The seals 16, 42, 64, 92 may also be made from a variety of materials including injection molded silicone, as well as a TPV, a TPR, a TPE, or other known polymeric materials.

While the specific embodiments have been illustrated and described, numerous modifications come to mind without significantly departing from the spirit of the invention, and the scope of protection is only limited by the scope of the accompanying Claims.

What is claimed is:

1. A storage container assembly comprising:

a storage receptacle having a base and a sidewall connected to the base, the sidewall projecting upward from the base and terminating at a peripheral edge, the sidewall having an interior surface and an exterior surface;

a removable lid having a main body configured to cover the peripheral edge of the storage receptacle, an annular first receiving channel defined by first and second channel walls, the first and second channel walls extending downward from a bottom surface of the removable lid, and a second receiving channel;

a seal having an annular securing member and an annular blade portion, the annular securing member being at least partially disposed in the first annular receiving channel of the lid for connecting the seal to the lid, the annular blade portion of the seal extending from the annular securing member and into the second receiving channel for contacting the interior surface of an upwardly projecting extent of the sidewall when the lid is connected to the storage receptacle; and wherein when the lid is connected to the storage receptacle, an upwardly projecting extent of the sidewall of the storage receptacle projects upwardly into the second receiving channel and the exterior surface of the upwardly projecting extent of the sidewall of the storage receptacle contacts an interior surface of the second receiving channel of the lid such that the upwardly projecting extent of the sidewall is located within the second receiving channel, and the blade portion of the seal forms a seal with the interior surface of the upwardly projecting extent of the sidewall when the sidewall is in contact with the second receiving channel.

2. The storage container assembly of claim 1, wherein the blade portion of the seal additionally comprises at least one rib, the rib adapted to contact the interior surface of the sidewall.

3. The storage container of claim 1, wherein the blade portion of the seal forms an angle of less than forty-five degrees (45°) from vertical while the blade portion contacts the interior surface of the sidewall.

4. The storage container assembly of claim 3, wherein the blade portion of the seal forms an angle of from ten degrees (10°) to forty-five degrees (45°) from vertical while the blade portion contacts the interior surface of the sidewall.

5. The storage container assembly of claim 1, wherein the securing member of the seal comprises a plurality of ribs configured to create a press fit within the first receiving channel of the lid.

6. The storage container assembly of claim 1, further comprising a vent disposed in the removable lid.

7. The storage container assembly of claim 1, further comprising a viewing window disposed in the removable lid and configured to provide visual confirmation that a seal has been formed between the lid and the storage receptacle.

8. A method of forming a container assembly, the method comprising:

providing a storage receptacle having a base and a sidewall, the sidewall projecting upward from the base and terminating at a peripheral edge, the sidewall having an interior surface and an exterior surface;

providing a removable lid having a flexible seal, the removable lid having an annular first receiving channel defined by first and second channel walls, the first and second channel walls extending downward from a bottom surface of the removable lid, and a second receiving channel, the flexible seal having an annular securing member and an annular blade portion, the annular securing member of the flexible seal being at least partially disposed in the annular first receiving channel of the lid for connecting the seal to the lid, the annular blade portion of the seal extending from the securing member toward an exterior wall of the second receiving channel;

aligning the removable lid with the storage receptacle, such that the second receiving channel is proximate to the peripheral edge of the sidewall of the storage receptacle; and securing the lid to the storage receptacle and causing an upwardly projecting extent of the sidewall of the storage receptacle to project upwardly into the second receiving channel and for the sidewall of the storage receptacle to deflect the blade portion of the seal into the second receiving channel, and further causing an interior surface of an upwardly projecting extent of the sidewall of the storage receptacle to contact the blade portion of the seal and an exterior surface of an upwardly projecting extent of the sidewall of the storage receptacle to contact an interior surface of the exterior wall of the second receiving channel.

9. The method of claim 8, wherein when the sidewall deflects the blade portion of the seal, the blade portion is deflected vertically.

10. The storage container assembly of claim 1, wherein the annual first receiving channel, annular securing member and the annular blade are each configured as one of a circular shape, a rectangular shape and an oval shape.

11. The method of claim 8, wherein the annual first receiving channel, annular securing member and the annular blade are each configured as one of a circular shape, a rectangular shape and an oval shape.

* * * * *